US007671260B2

(12) United States Patent
Fujii et al.

(10) Patent No.: US 7,671,260 B2
(45) Date of Patent: Mar. 2, 2010

(54) COMPONENT OF MUSICAL INSTRUMENT, MUSICAL INSTRUMENT AND PRODUCTION METHOD OF THE SAME

(75) Inventors: Junji Fujii, Hamamatsu (JP); Hiroyasu Abe, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 274 days.

(21) Appl. No.: 11/507,177

(22) Filed: Aug. 21, 2006

(65) Prior Publication Data

US 2007/0044631 A1 Mar. 1, 2007

(30) Foreign Application Priority Data

Aug. 23, 2005 (JP) ..... 2005-241052

(51) Int. Cl.
*G10D 3/00* (2006.01)

(52) U.S. Cl. ..... 84/291

(58) Field of Classification Search ..... 84/267, 84/291, 274, 275

See application file for complete search history.

(56) References Cited

U.S. PATENT DOCUMENTS

| | | | | |
|---|---|---|---|---|
| 1,836,089 | A | 12/1931 | Schweitzer | |
| 6,210,865 | B1 | 4/2001 | Sweatt et al. | 430/311 |
| 6,229,652 | B1 | 5/2001 | Bajt et al. | 359/584 |
| 6,319,635 | B1 | 11/2001 | Mirkarimi et al. | 430/5 |
| 6,549,551 | B2 | 4/2003 | Ness et al. | 372/38.07 |
| 6,567,450 | B2 | 5/2003 | Myers et al. | 372/55 |
| 6,625,191 | B2 | 9/2003 | Knowles et al. | 372/55 |
| 6,780,496 | B2 | 8/2004 | Bajt et al. | 428/216 |
| 6,797,210 | B2 * | 9/2004 | Iijima | 264/112 |
| 2003/0008148 | A1 | 1/2003 | Bajt et al. | 428/408 |

(Continued)

FOREIGN PATENT DOCUMENTS

DE 365672 C 12/1922

(Continued)

OTHER PUBLICATIONS

"European Search Report," European Patent Office (Munich), (Nov. 15, 2006).

(Continued)

*Primary Examiner*—Kimberly R Lockett
(74) *Attorney, Agent, or Firm*—Pillsbury Winthrop Shaw Pittman LLP

(57) ABSTRACT

A production method of a musical instrument and its components (parts, materials or the like), a musical instrument and its components obtained in accordance with the methods that can achieve the effect of increased sound quality of the musical instrument because of deterioration with age after many years by reforming the quality of the coating layer on the surface of the musical instrument or its components in a short time, are provided. A production method of a musical instrument and of a component of the musical instrument includes steps of: coating the component; and irradiating ultraviolet that has the highest peak value of strength in the far ultraviolet wavelength region on a coating layer, and the musical instrument or the component of the musical instrument are made in accordance with this method. It is preferable that energy of the ultraviolet light at the far ultraviolet wavelength region is 50% or more of total energy of the ultraviolet light and the ultraviolet light is irradiated in a vacuumed atmosphere or in an inert gas atmosphere.

12 Claims, 10 Drawing Sheets

U.S. PATENT DOCUMENTS

| | | | | |
|---|---|---|---|---|
| 2003/0008162 | A1* | 1/2003 | Oya et al. | 428/480 |
| 2003/0224620 | A1 | 12/2003 | Kools et al. | 438/776 |
| 2004/0245677 | A1* | 12/2004 | Marple et al. | 264/496 |
| 2005/0003672 | A1 | 1/2005 | Kools et al. | 438/698 |
| 2005/0103182 | A1* | 5/2005 | Spurgeon | 84/291 |

FOREIGN PATENT DOCUMENTS

| | | | |
|---|---|---|---|
| EP | 0936504 | A1 | 8/1999 |
| EP | 1343047 | A2 | 10/2003 |
| EP | 1531454 | A2 | 5/2005 |
| JP | 10105159 | | 4/1998 |

OTHER PUBLICATIONS

Bajt, et al, "Oxidation Resistance and Microstructure of Ruthenium-Capped Extreme Ultraviolet Lithography Multilayers", *J. Microlith., Microfab., Microsyst*. vol. 5 (2) pp. 023004-1-023004-13, (Apr.-Jun. 2006).

Braun et al, "Carbon Buffer Layers For Smoothing Substrates of EUV and X-Ray Multilayers Mirrors", *Proc. Of SPIE*, vol. 5392, pp. 132-140 (2004).

Braun, et al, "Smoothing Of Substrate Roughness By Carbon-Based Layers Prepared By Pulsed Laser Deposition (PLD)", *SPIE*, vol. 5533, pp. 75-84 (2004).

Kleineberg, et al, "Bufferlayer and Caplayer Engineering of Mo/Si EUVL Multilayer Mirrors", *SPIE*, vol. 4506, pp. 113-120 (2001).

U.S. Appl. No. 11/174,299, filed Jun. 29, 2005, Ershov et al.

* cited by examiner

* MAXIMUM VALUE OF ENERGY IS SHOWN AS 100%

COMPONENT OF MUSICAL INSTRUMENT, MUSICAL INSTRUMENT AND PRODUCTION METHOD OF THE SAME

BACKGROUND OF THE INTENTION

1. Field of the Invention

The present invention relates to a component of a musical instrument, a component of the musical instrument which is made by irradiating far ultraviolet rays on a coating layer of the musical instrument, the musical instrument and a production method of the same.

Priority is claimed on Japanese Patent Application No. 2005-241052, filed Aug. 23, 2005, the content of which is incorporated herein by reference.

2. Description of the Related Art

It is known from experience that a musical instrument, especially a stringed instrument such as a violin and the like, have higher quality sound after many years under ideal conditions of playing and maintenance rather than at the time when it was made.

For example, the coating layer on the surface of the musical instrument has an influence on the audible signals over 4000 Hz at a high frequency region in the form of a surface wave vibration. This surface wave vibration has small vibration amplitude and is a transient signal, therefore, it is difficult to measure and evaluate. However, from experience, it is known that the sound of a musical instrument changes in accordance with a characteristic of the coating layer on the surface of the musical instrument. The coating layer changing as years go by is considered one of the reasons of the increasing sound quality.

Specifically, the characteristics of the coating layer that increase the quality of the sound of the musical instrument are high loss and low elasticity. Hence, it is considered that high loss and/or low elasticity of the coating layer cause the increase of sound quality because of deterioration with age.

Therefore, if it is possible to achieve the above-described characteristics of the coating layer in a short time, it is possible to obtain a high quality sound even though the musical instrument was just produced.

There are methods for causing the same effects as deterioration with age, for example, a method of causing an oxidation by exposing the musical instrument in ozone (see a patent document 1: Japanese Patent Application, First Publication No. H10-105159) or a method of irradiating ultraviolet rays on the musical instrument (see a patent document 2: specification of U.S. Pat. No. 1,836,089).

However, the invention described in patent document 1 has problems of not only using harmful ozone, but also taking a long time i.e. 2-6 months, for the ozone treatment. In the invention described in patent document 2, only a method of reforming the quality by applying a near ultraviolet ray which has a low energy level in ultraviolet rays is disclosed, therefore, its effect in raising the quality of sound is not sufficient and there is a problem in that it takes a long time, i.e. longer than 24 hours, for irradiating.

The present invention was devised in order to address the above-described problems and has an object to provide a production method for a musical instrument or its components (parts, materials or the like), a musical instrument and its components obtained by the method that can achieve an effect of increased sound quality of the musical instrument because of deterioration with age after many years of reforming the quality of the coating layer on the surface of the musical instrument or its components in a short time.

SUMMARY OF THE INVENTION

In order to achieve the object above, a first aspect of the present invention is a component of a musical instrument including a coating layer on which ultraviolet rays that have the highest peak value of strength in the far ultraviolet wavelength region are irradiated.

A second aspect of the present invention is a component of the musical instrument described above, wherein energy of the ultraviolet rays at the far ultraviolet wavelength region is 50% or more of the total energy of the ultraviolet.

A third aspect of the present invention is a component of the musical instrument described above, wherein the ultraviolet rays are irradiated in a vacuum.

A fourth aspect of the present invention is a component of the musical instrument described above, wherein the ultraviolet rays are irradiated in an inert gas atmosphere.

A fifth aspect of the present invention is a musical instrument including a component of the musical instrument described above.

A sixth aspect of the present invention is a musical instrument including a coating layer on which ultraviolet rays that have the highest peak value of strength in the far ultraviolet wavelength region are irradiated.

A seventh aspect of the present invention is a production method of a component of a musical instrument including steps of: coating the component, and irradiating ultraviolet rays that have the highest peak value of strength in a far ultraviolet wavelength region on a coating layer.

An eighth aspect of the present invention is a production method of a musical instrument including steps of: coating on the musical instrument, and irradiating ultraviolet rays that have the highest peak value of strength in the far ultraviolet wavelength region on a coating layer.

In accordance with the present invention, by applying far ultraviolet with a high energy level, it is possible to reform the quality of the coating layer on the surface of the musical instrument or its component in an extremely short irradiation time such as 30 minutes, and it is possible to provide the musical instrument with an excellent sound quality that is almost equal to a musical instrument after deterioration with age. Moreover, not only is it possible to increase the sound quality, but it is also possible to achieve a beautiful looking surface by making the coating layer clear.

A step of reforming the quality is easily completed in a short time, therefore, it is possible to provide the musical instrument cost-effectively.

DETAILED DESCRIPTION OF THE INVENTION

Figure 1A:
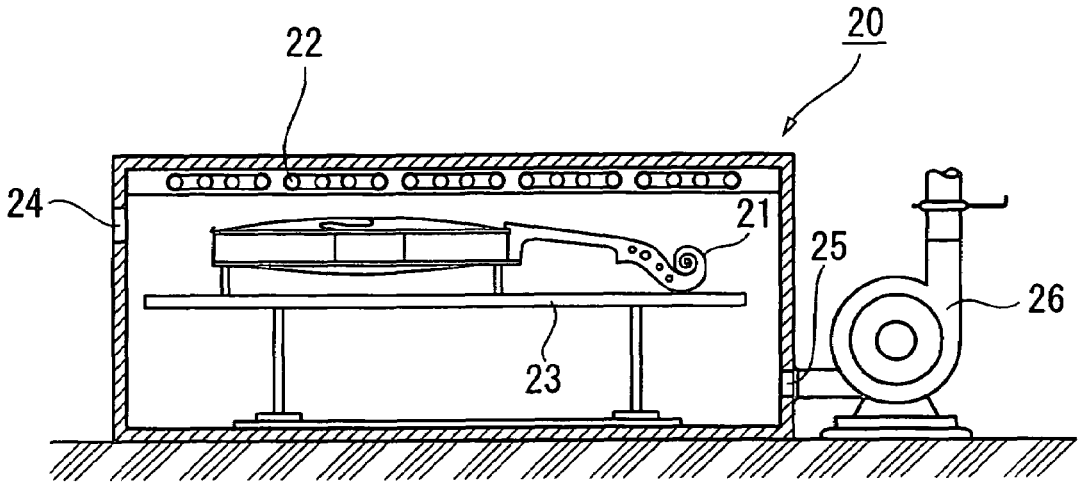
FIG. 1A is an outline cross-section showing example steps of a reforming method of a coating layer of a second embodiment of the present invention.

Hereinafter, the present invention is explained in detail.

Ultraviolet rays are divided into three categories in accordance with their wave length. That is, UVA (near ultraviolet, 320-400 nm), UVB (for ultraviolet 280-320 nm) and UVC (far ultraviolet, less than 280 nm).

Among them, in the present invention, the ultraviolet ray that has a highest peak value of intensity at a wavelength region of far ultraviolet rays (hereafter, abbreviated to UVC) is applied. It is preferable that the amount of energy of UVC in the ultraviolet ray is over 50% of the total amount of energy.

It is possible to obtain UVC from a light source such as, for example, a low-pressure mercury lamp, an excimer lamp or the like.

In the present invention, UVC is irradiated on a coating layer on components of the musical instrument which is made by coating the wood for the musical instrument, it is possible to obtain a musical instrument with excellent sound quality that is the same musical instruments with age deterioration. Moreover, it is similarly possible to obtain a musical instrument with excellent sound quality by irradiating with UVC on the coating layer of the musical instrument which is a finished product produced in accordance with commonly used methods. Improvement of sound quality by irradiating with UVC is effective especially for fiddles such as a violin, a viola, a cello, a double bass and the like.

In the present invention, UVC is irradiated on the coating layer of the musical instrument or its components, however, when it is irradiated on the musical instrument, it is preferable to irradiate at least on whole coating layer of a sounding board that constitutes the musical instrument. For example, in a case of violin, it is preferable to irradiate on the coating layer of all of front face, back face, and side face. The component of the musical instrument includes members of minimum units that constitute the musical instrument and a combination of them.

In the present invention, it is possible to irradiate UVC on the coating layer of the musical instrument or its components in air, however, harmful ozone gas is generated, therefore, it is preferable that a UVC irradiation apparatus provides a ventilation pump for discharging air inside the apparatus.

In order to increase the effects of irradiation along with preventing generation of ozone gas, it is preferable to irradiate UVC in inert gas instead of air and it is more preferable in a vacuum. Nitrogen, helium, argon and the like are recommended as preferable inert gases.

Regardless of irradiating in air, gas or the like, in the UVC irradiation apparatus, the musical instrument or its components are mounted on a rotation table or the like and are irradiated with UVC while rotating, therefore, it is possible to irradiate evenly on them.

In the present invention, it is preferable to set a distance between the coating layer and a light source to be 50 mm or smaller. It should be noted that, with respect to a musical instrument having large uneven portions such as the surface of violin, it is preferable to set the distance to 125 mm or less, and more preferably, it is 115 mm or less. UVC is a range of wavelength which is easily attenuated with distance because of oxygen in the air, therefore, it is important not to set the coating layer far from the light source. Upon applying the distance above, it is possible to obtain enough effect to reform the quality of the coating layer even in air.

In the present invention, in order to prevent degeneration or degradation such as chaps or cracks due to the raising temperature of the coating layer because of heat generated by the UVC light source or UVC, it is preferable to maintain the temperature of the coating layer at 75° C. or lower while irradiating with UVC. In order to control the temperature of the coating layer in such manner, it is preferable to irradiate UVC on the coating layer intermittently. Moreover, in this case, in time when UVC is not irradiated, it is more preferable to set the musical instrument or its components apart from the UVC light source and to blow compressed air on the irradiated surface to cool it down forcibly. Moreover, it is especially preferable that a compressed air discharging nozzle and a suction pump are provided to the UVC irradiation apparatus and UVC is irradiated while discharging air outside from the UVC irradiation apparatus along with discharging compressed air on the coating layer from the nozzle.

In the present invention, the total time for irradiating with UVC on the coating layer is preferably 18 minutes or longer, and more preferably 24 minutes or longer.

In the present invention, there is no limitation on the coating layer on which UVC is irradiated if it is generally used for musical instruments. For example, it is preferable that the coating layer is made from oil varnish, polyester resin coating, polyurethane resin coating, amino alkyd resin coating, urethane modified alkyd resin coating, cellulose lacquer coating, and alcohol varnish.

It is preferable that the thickness of the coating layer, depending on its variety, is 10-110 μm.

It is appropriate to apply wood generally used for producing the musical instrument to the components or a material of the musical instrument used in the present invention with no limitation, therefore, for example, spruce, maple, horn beam and the like, moreover, wooden materials and the like such as veneer board and the like to which sliced veneers of such natural wood are given as examples.

It is possible to produce the musical instrument in accordance with a general method from the components of the musical instrument to which UVC is already irradiated and is obtained in the present invention.

The components of the musical instruments mean all wood members or components that are coated on their surfaces and constitute musical instruments, for example: sounding boards and members of fiddles such as violins, violas, cellos, double basses and the like; sounding boards and members of plucked string instruments such as acoustic guitars, electric guitars, harps, Japanese harps, Taisho lyres, cembalos and the like; sounding boards and members of struck string instruments such as pianos and the like: with respect to percussion instruments, sounding boards of marimbas, wood piles and the like; cylinders and members of a drums, a Japanese drum and the like; the main body of woodblocks, wood clappers and the like; with respect to wind instruments, the main body, members and the like of woodwinds and the like; and with respect to other musical instruments, wood pipes of pipe organs and the like. The musical instruments, hereinafter, includes musical instruments that are constituted by applying the components or the members described above.

Hereinafter, with respect to sound improvement of a musical instrument by reforming the coating layer of the present invention, its effects and mechanism are explained concretely. It should be noted that the method explained hereafter is a methodology which will be called "aged coating", and is invented in view of the fact that coating layers on old musical instruments show excellent auditory performance.

Figure 8:
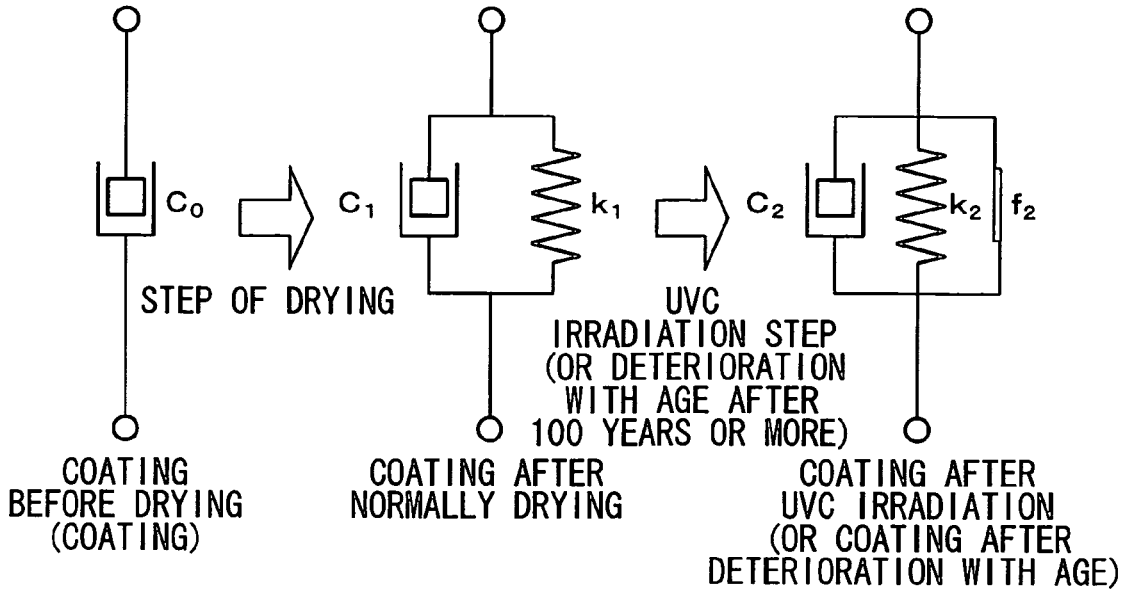
FIG. 8 is a figure showing a static physical characteristic model of the coating layer.

FIG. 8 shows the static physical characteristic model (the rheology model and the viscoelasticity model) of the coating layer.

A state of the coating (or the coating layer) which is not dried after coating is shown on the left. Such a state just has a viscosity dissipation factor $C_0$ and does not have a solid elastic characteristic, therefore, there is no ability of form retention or ability to maintain its form. After drying from such a state, as shown in a center, an elastic coefficient $k_1$ is generated, $C_0$ is reduced to $C_1$, the state is solidified and the form becomes stable, and the function of the coating layer becomes effective. It should be noted that this elasticity is one reason of reducing vibration amplitude and the sound of the musical instrument is deteriorated.

In this state, when UVC is irradiated in accordance with the present invention, a dry dissipation factor $f_2$ is caused as shown on the right. Such a phenomena proceeds along with the elastic coefficient $k_1$ which is an elastic characteristic being broken in a micro scale and a result such as $k_1>k_2$ is obtained. That is, even though the coating layer is dried, it is possible to prevent the sound of the musical instrument from being worse. Moreover, $f_2$ is a dissipation element, however, $f_2$ is a dry dissipation which is better than the viscosity loss factor $C_n$ which is a viscosity characteristic, and $f_2$ is a characteristic which relates to, as an image of the musical instrument, a "dry sound" literally.

In order to connect such a static characteristic of the coating layer to the sound characteristic, the vibration characteristic model of this model is explained below.

Figure 9:
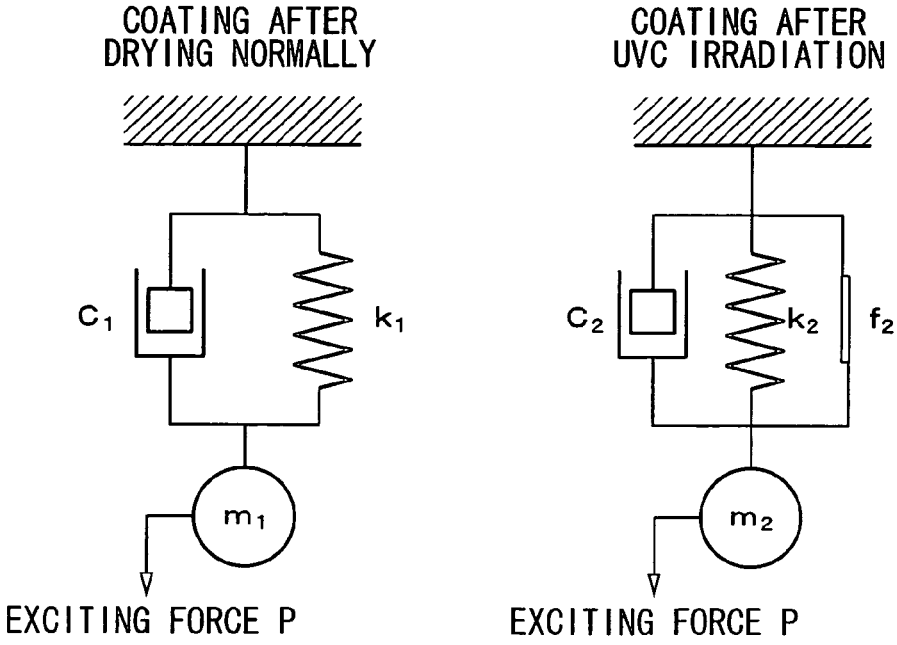
FIG. 9 is a figure showing a dynamic characteristic model of the coating layer taking into account the mass of the coating.

FIG. 9 shows a dynamic characteristic model obtained by considering the weight of the coating in the static characteristic model, the left side shows the coating layer after drying normally and right side shows the coating layer after irradiating with UVC.

P is the exciting force such as a force of vibration transmitted from the strings of a stringed instrument. It is appropriate that the weight of the coating $m_1$ and $m_2$ be almost unchanged before and after irradiating the instrument with UVC, therefore, $m_1 \approx m_2$. It should be noted that, in this model, it is not possible to control the coating layer in liquid state before drying.

An equation of a viscoelasticity model (Voigt model) is shown left in FIG. 9.

$$m\ddot{x}+c\dot{x}+kx=P_0 \sin \omega t \qquad (1)\ (P=P_0 \sin \omega t)$$

The solution of this equation is shown below.

$$x_0 = \frac{P_0}{k\sqrt{\left(1-\frac{\omega^2}{\omega_n^2}\right)^2+\left(\frac{2c}{c_c}\cdot\frac{\omega}{\omega_n}\right)^2}} \qquad (2)$$

$\omega_n$ is a resonance frequency of this vibration system, $c_c$ is a critical damping coefficient (critical dissipation factor) and they have a relationship as shown below.

$$\omega_n = \sqrt{\frac{k}{m}} = \frac{c_c}{2m} \qquad (3)$$

A static deflection by the exciting force $P_0$ on this system is shown below.

$$x_{st} = \frac{P_0}{k} \qquad (4)$$

Amplitude is normalized by this, as shown below.

$$\frac{x_0}{x_{st}} = \frac{1}{\sqrt{\left(1-\frac{\omega^2}{\omega_n^2}\right)^2+\left(\frac{2c}{c_c}\cdot\frac{\omega}{\omega_n}\right)^2}} \qquad (2)'$$

The maximum amplitude is obtained when a denominator of (2)' is minimized, therefore, such a condition is determined in accordance with a case in which a differential of the denominator by $\omega/\omega_n$ is zero.

$$\frac{\omega}{\omega_n} = \sqrt{1-2\left(\frac{c}{c_c}\right)^2} \qquad (5)$$

And the following result is obtained.

$$\left(\frac{x_0}{x_{st}}\right)_{max} = \frac{1}{\frac{2c}{c_c}\sqrt{1-\left(\frac{c}{c_c}\right)^2}} \qquad (2)''$$

In general, $c/c_c$ is much smaller than 1, therefore, $(c/c_c)^2$ is omitted.

$$\left(\frac{x_0}{x_{st}}\right)_{max} \approx \frac{c_c}{2c} = Q \qquad (2)'''$$

In this formula, Q is defined and Q has a relationship as follows.

$$Q = \frac{\pi}{\delta}\ (\delta\text{: logarithmic decrement}) \qquad (6)$$

The larger Q is, the smaller the damping capacity of vibration is. In accordance with the relationship of (3), it is expressed as follows.

$$Q = \frac{c_c}{2c} = \frac{\sqrt{km}}{c} \qquad (2)''''$$

As described above, in the drying step of the coating layer, c is decreased and k occurs and increases. In this step, because of the drying of solvent and the like, m is decreased to some extent. Such phenomena are confirmed by applying the formula (2)''''. Along with proceeding with the drying of the coating layer, Q increases, the damping capacity of vibration which is the acoustic object of the coating layer decreases, and the frequency characteristic of the resonance loses flatness, becomes uneven and is not preferable.

However, by irradiating with UVC on this dried coating layer, in this vibration system, $k_1$ changes to $k_2$ and $f_2$ ($k_1>k_2$) and changes as shown on the right side of FIG. 9. In the case of the right side, a oscillation equation is as shown below.

$$m\ddot{x}+c\dot{x}+kx\pm f=P_0 \sin \omega t \qquad (7)$$

In this case, the dissipation factor is approximately expressed below by applying an equivalent dissipation factor $c_{eq}$.

$$c_{eq} = \frac{4f}{\pi x_Q \omega} + c \qquad (8)$$

The phenomena can be approximately dealt by applying this equation and replacing with c at the Voigt model equation (1).

It can be understood from the formula (8) that, by operating with UVC, the dissipation increases while k decreases. Because of such the phenomena, even though the coating layer is dried, the increase of Q is prevented and the broadness of damping capacity and the resonance that is a primal acoustic effect of the coating layer is maintained. When k is rather small, in accordance with the formula (4), $x_{st}$ with respect to the same exciting force $P_0$ is large. Considering the formula (2)''', in cases of applying same Q, that is, the resonance characteristics are similarly broad with respect to frequency, it is possible to obtain larger vibration amplitude, that is, it is possible to obtain better sounds instrumentally and acoustically. With respect to natural musical instruments or non-electrical instruments, human power is the source of energy for generating sounds, therefore, if quality characteristics of tones are same, as a performance of the musical instrument, it is a greatly important point that larger sounds (acoustic radiation) can be generated with respect to same input.

As described above, the coating layer is "broken in a micro scale" by irradiating with UVC, and k which is generated and increased by drying the coating layer is controlled along with compensating reduced C by f, in other words, some degree of k is converted to f, this is why it is possible to obtain the coating layer in acoustically good condition even though it is dried.

Embodiments

Hereinafter, practical embodiments are shown and the present invention is explained in detail. Practically, an example of reforming the coating layer of a manufactured violin is explained. It should be noted that the present invention is not limited by the following embodiments at all.

A First Embodiment

UVC is irradiated on a violin by applying UVC irradiation apparatus (excimer UV/$O_3$ cleaning apparatus) which is sold to the public and which provides an excimer lamp, and sound quality changes of the violin are evaluated. Table.1 shows on outline of the UVC irradiation apparatus.

Figure 10:
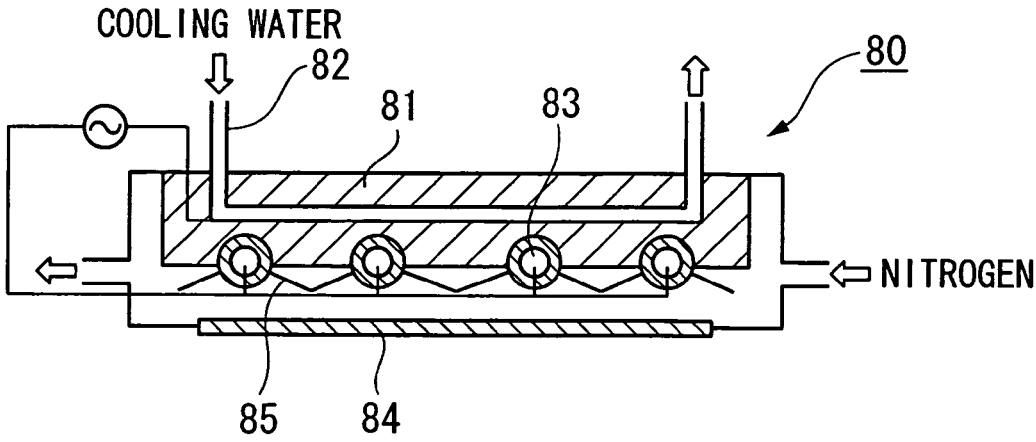
FIG. 10 is an outline cross-section showing a lamp house of a far ultraviolet irradiation apparatus applied in a first embodiment of the present invention.

Two types of excimer lamps having such a spectrum, that is, having peaks of intensity at wavelengths of 172 nm and 222 nm, are applied, and six lamps of each type are fixed at a lamp house 80 in the apparatus shown in FIG. 10 by using a metal block 81. The range of the amount of energy of the UVC is 80% or more of the total ultraviolet energy. The metal block 81 has a coolant passage 82 and the excimer lamp 83 is cooled by the cooling water via the metal block 81.

In the lamp house 80, an angle mirror 85 is provided between the excimer lamps 83, therefore, UVC is put out efficiently and the irradiance distribution on the window surface is designed to be equal and uniform. A synthetic quartz windowpane 84 is provided on the front surface of the excimer lamp 83 in order to prevent conducting heat of the lamps on the irradiated object and to irradiate UVC efficiently. A metal case in which the excimer lamp 83, the metal block 81 and the angle mirror 85 are installed is filled with nitrogen gas and the nitrogen gas does not absorb light of 172 nm, therefore, it is possible to produce UVC efficiently and to prevent oxidation of the electrodes of the lamps and the angle mirror 85.

TABLE 1

| | |
|---|---|
| Outline size | 1,050 mm × 1,300 mm × 1,200 mm |
| Window opening size | 750 mm × 950 mm |
| Number of installed lamps | 12 (6 + 6) |
| Irradiance | 12 mW/cm$^2$ |
| Degree of uniformity of irradiance distribution (window surface) | Within ±15% |
| Amount of flowing nitrogen | 40 NL/min (10-30° C.) |
| Amount of cooling water | 2-3 NL/min (10-30° C.) |
| Power source size | 500 mm × 700 mm × 200 mm |

Figure 11:
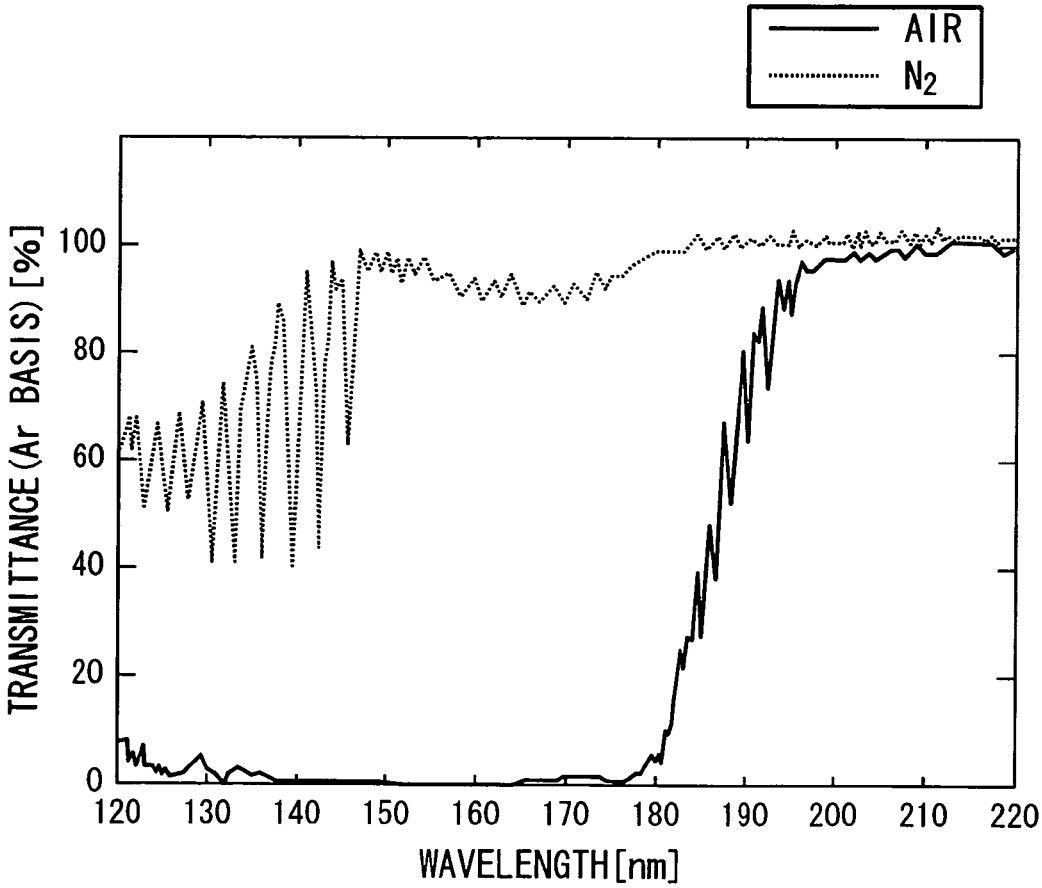
FIG. 11 is a graph showing transmittance of the far ultraviolet of each wavelength in air and in nitrogen gas.

On the other hand, FIG. 11 shows the transmittance of ultraviolet rays at each wave length in the air and the nitrogen gas. It is clear that the ultraviolet rays of 172 nm are absorbed by oxygen in the air, therefore, in order to apply the ultraviolet of this wavelength, an environment in which UVC irradiation is operated should be vacuumed or the air should be replaced by the nitrogen gas. In this embodiment, the air is replaced by the nitrogen gas in the irradiation apparatus.

In this embodiment, two violins which have very similar sounds are selected from the same production lot. Both of these violins are finished by polishing their surfaces after spraying and brushing a urethane modified alkyd resin coating. The coating thickness is, on front, back and side face, 20-50 μm and agrees to a production specification, that is, there is no significant difference between them. In this embodiment, 3 months after producing these two violins, the operation was conducted after confirming both of them were dried enough.

Concrete steps of this embodiment are as below. A table was set inside the UVC irradiation apparatus and a violin was mounted on the table so as to set a distance from the synthetic quartz windowpane 84 in the UVC irradiation apparatus 100 mm. After irradiating with UVC on the violin continuously for 5 minutes, the violin was taken out of the apparatus and is forcibly cooled for 10 minutes by blowing compressed air from a compressor on the irradiated surface of the violin. This operation was one cycle, and 6 cycles of UVC irradiation operation were conducted in total. That is, the UVC irradiation time was 30 minutes.

The temperature of the irradiated surface just after irradiation and removal from the UVC irradiation apparatus was 55-70° C.

Using the violin on which UVC was irradiated and a violin on which UVC was not irradiated, an amateur violinist who was a person of research and development was asked to play experimentally, and the violins were evaluated by the developers including the violinist. As a result, the irradiated violin was evaluated and the quality of sound was clearly improved. Comments such as "the violin sounds large and dynamic", "the sound carries much better", "the sound is not rough and very easy to listen to", "the value of the musical instrument is raised 2 or 3 grades higher (the sound of the violin is similar to a violin 2-4 times more expensive)", "the sound became warm", or the like were made.

The violins used in the experiment that were confirmed to have their coating layers dried sufficiently, therefore, the change in the sound quality is not a chemical effect, e.g. proceeding drying of the coating, but a physical change in the coating layer due to the UVC.

In the embodiment below, a relationship between UVC irradiation and improvement of the sound quality is confirmed by using coatings other than the urethane modified alkyd resin coating used in the first embodiment, and by using a practical UVC irradiation apparatus.

A Second Embodiment

Under the condition of table 2, UVC is irradiated on a violin from a UVC irradiation apparatus shown in FIG. 1, and changes in the sound quality of the violin is evaluated.

FIG. 1A is an outline cross section of the irradiation apparatus, and numeral 20 is the main body of the UVC irradiation apparatus and is shaped approximately in a rectangular parallelepiped. A low-pressure mercury lamp 22 is provided on an upper surface inside the main body as a UVC light source. On the bottom surface of the UVC irradiation apparatus 20, a mounting table 23 for mounting a UVC irradiation object is provided, and a violin 21 is mounted in this embodiment.

Figure 1B:
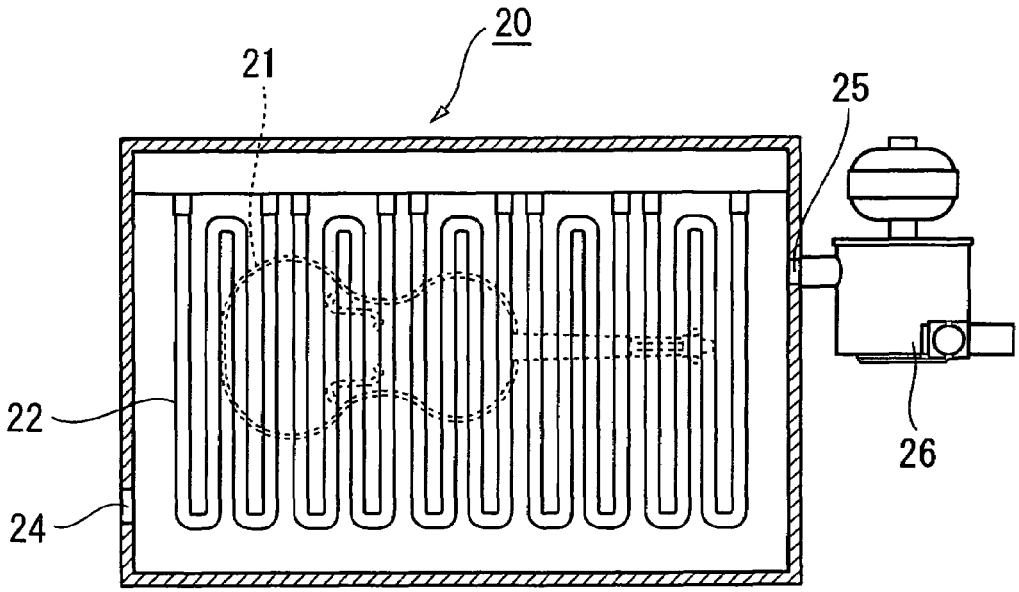
FIG. 1B is an outline cross-section showing example steps of a reforming method of a coating layer of a second embodiment of the present invention.

On the other hand, on one side of the UVC irradiation apparatus, a ventilation pump 26 is provided via an outlet 25, and on an opposing side face, an inlet 24 is provided, and therefore, harmful ozone generated by irradiating with UVC is always evacuated out of the UVC irradiation apparatus 20 and air is taken into the UVC irradiation apparatus 20. FIG. 1B is an outline plane figure showing the apparatus from an upper surface side.

Figure 12:
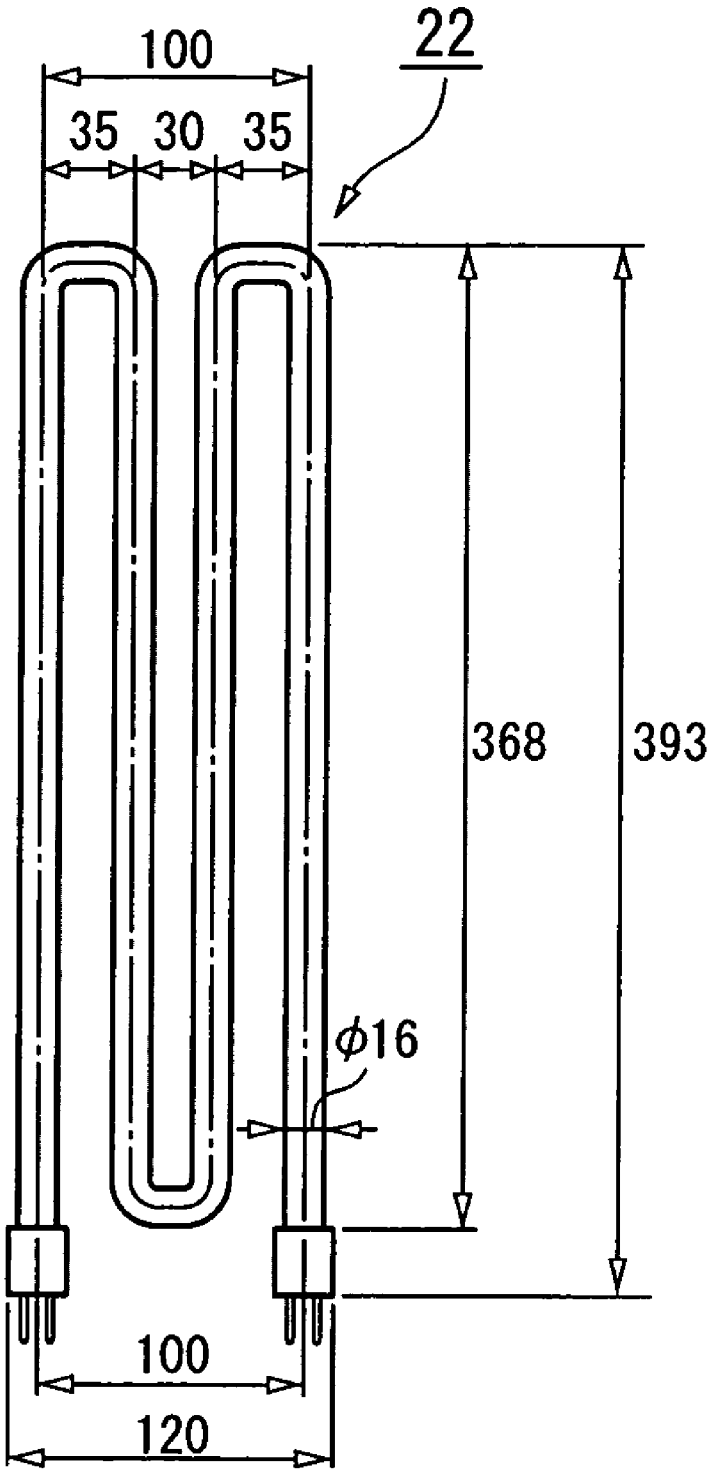
FIG. 12 is an outline plane figure of a low-pressure mercury lamp applied in an embodiment of the present invention.

FIG. 12 is an outline plane figure of the low-pressure mercury lamp 22 used in this embodiment, and the unit of size in this figure is mm.

Figure 13:
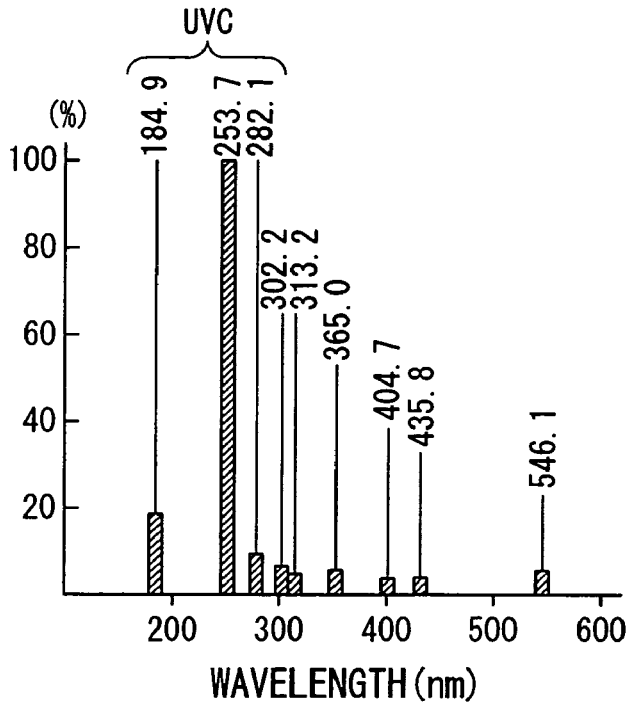
FIG. 13 is a graph showing a spectral distribution of the low-pressure mercury lamp used in an embodiment of the present invention.

FIG. 13 is a graph showing a spectrum distribution of the low-pressure mercury lamp 22. Main spectrums are 253.7 nm and 184.9 nm. The highest peak value is 253.7 nm. It is known that, at UVC of 184.9 nm that has an especially high energy level, it is possible to cut the backbone chain and the branched chain of an organic compound.

The UVC light source used in this embodiment is not limited as described in this document as long as UVC wavelength region is used as a main spectrum. The amount of energy in the UVC region is 50% or more of the total amount of energy. This is the same in the following embodiments.

On the violin 21 used in this embodiment, conventional oil varnish was brushed and coated on its surface, the coating thickness was 10-40 μm, and the instrument was let dry for one month. Using this violin, the evaluation was conducted in the following steps.

◎ UVC Operation on the Surface (Sound Board)

The violin 21 was mounted on the mounting table so as to set the uppermost portion of its front surface (sound board) at 30 mm from the lowermost portion of the low-pressure mercury lamp 22, by adjusting the height with a jig for fixing (not shown in figures). On this occasion, the whole board of the violin 21 was set at 50 mm or closer from the lowermost portion of the low-pressure mercury lamp 22. It should be noted that the violin 21 was set in a state in which a finger board on which the coating was not applied was taken off. The same is true in embodiments below. When the finger board was not taken off, it was appropriate to cover the finger board with aluminum foil or the like which was an ultraviolet screening sheet.

The ventilation pump 26 was started and UVC from the low-pressure mercury lamp was irradiated on the violin 21 for 5 minutes continuously. After that, the violin 21 was taken out of the UVC irradiation apparatus 20 and compressed air from a compressor (not shown in figures) was blown on the irradiated surface in order to cool it down. This operation was one cycle and in total 6 cycles of UVC irradiation were conducted. That is, the total time of UVC irradiation was 30 minutes.

It was observed that the temperature of the irradiated surface just after removal from the UVC irradiation apparatus 20 was 55-65° C., however, by blowing with compressed air, it dropped to approximately a room temperature (25° C.). Therefore, when this operation is conducted in a room providing an air conditioner set to a low temperature, it is possible to shorten the time for cooling down and to shorten the total operation time.

◎ UVC Operation on a Back Face

Same as the front face, UVC was irradiated on the back face of the violin 21 for 30 minutes total. After UVC irradiation, the temperature of the irradiation surface was 55-65° C.

◎ UVC Operation on Side Faces

The violin 21 had bumpy side faces, and it was difficult to irradiate UVC uniformly and equally on the side faces. Therefore, the violin 21 was set on the mounting table 23 sideways in order to set whole the board of the violin 21 at 15-115 mm from the lowermost portion of the low-pressure mercury lamp 22. It should be noted that portions far from the lowermost portions of the low-pressure mercury lamp 22 are not important for sound quality, therefore, such differences in distance was not a big problem.

After UVC from the low-pressure mercury lamp was irradiated on the violin 21 continuously for 3 minutes, the violin 21 was taken out of the UVC irradiation apparatus 20 and compressed air from a compressor was blown on the irradiated surface to continuously it cool down for 7 minutes. This operation was one cycle and 6 cycles of UVC irradiation were conducted in total. That is, the total time of UVC irradiation was 18 minutes on one side of the side faces. The same operation was conducted on the other side and irradiation was operated in total for 36 minutes.

It was observed that the temperature of the irradiated surface just after taking out of the UVC irradiation apparatus 20 was 75° C. at a portion which is closest from the low-pressure mercury lamp 22, and 50° C. or lower at a portion which is farthest from the low-pressure mercury lamp 22. Harmful degradation such as affection of the coating layer, severe flowing, running or the like was not observed in either portion.

Sound quality was evaluated in accordance with following manner by using two violins, one of them was the violin 21 on which the UVC was irradiated in the above manner, and another was the violin which was made at same time from materials with similar characteristics in the same production method in which the UVC irradiation was not performed.

The violins were played as a test in a large hall and a small hall, by an amateur player who was a developer of violins and a professional player who was teaching in a music collage, and the sound quality was evaluated by 6-10 people including musical instrument designers, violin manufacturers, material researchers, delivery inspectors of violins, and players. It should be noted that differences between the violins were not explained to the players and the evaluators before playing and evaluating.

As a result, all the evaluators could recognize differences based on whether or not UVC was irradiated. That is, with respect to the violin on which UVC irradiation was conducted, comments such as "the sound is nicely seasoned (matured)", "it is unbelievable that the violin was just made", "it can be heard even though it is far away", "there are almost no unpleasant noises", or "there is almost no disturbance among sound pitches, and a balance of tenor note strings and bass note strings is excellent" were made. Therefore, it was evaluated to be musically excellent.

In another case, the violins were evaluated by 10 members of an amateur orchestra and multiple professional players in the same manner, and the violin on which UVC irradiation was conducted was evaluated to have better sound quality by 70-80% in their opinions.

A Third Embodiment

A violin 31 which has similar characteristics of the violin of the second embodiment was selected and UVC irradiation was performed as shown below. Wood materials of violins, even if they are obtained from the same kind of wood, they can have different characteristics, therefore, in this embodiment, wood materials which were close to the violin of the second embodiment, especially with respect to a density, the modulus of elasticity and the Q-value, were selected. Furthermore, a violin 31 which is coated by the same method and had the same coating thickness as the violin of the second embodiment was selected.

Figure 2:
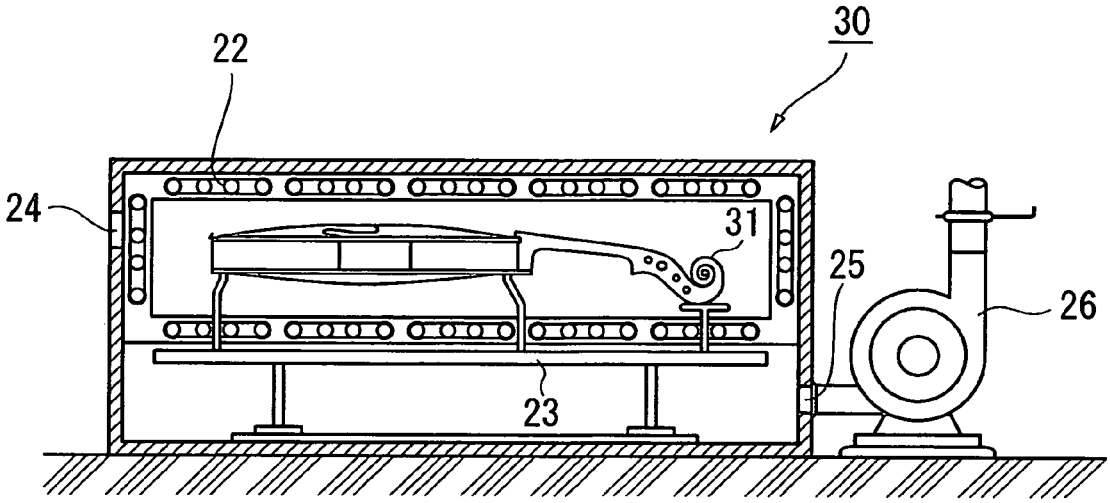
FIG. 2 is an outline cross-section showing example steps of a reforming method of a coating layer of a third embodiment of the present invention.

By applying the UVC irradiation apparatus 30 shown in FIG. 2, UVC was irradiated on the violin 31 in accordance with conditions shown in Table 2, and the sound quality changes of the violin 31 were evaluated. That is, in the UVC irradiation apparatus 30, the low-pressure mercury lamps 22 were set so as to surround the violin 31. (In FIG. 2, the low-pressure mercury lamps 22 on directions of the side face of the violin 31 are omitted.) In this case, the distance between the front/back face and the low-pressure mercury lamp 22 is set to be the same as the second embodiment, and the distance between the side face and the low-pressure mercury lamp 22 is set to be 25-125 mm.

After irradiating with UVC on the front, back, and side faces of the violin 31 continuously for 3 minutes, the violin 31 was taken out of the UVC irradiation apparatus 30 and was forcibly cooled for 12 minutes by blowing compressed air from a compressor on the irradiated surfaces, and such a cycle was conducted 10 times in total. That is, UVC irradiation time was totally 30 minutes per one surface.

It was observed that the temperature of the irradiated surface just after UVC irradiation was 65-68° C., and harmful degradation such as affection of the coating layer, severe flowing or running or the like was not observed on the coating layer.

When the professional player played the violin 31 of this embodiment, the evaluation was almost the same sound quality as the second embodiment.

A Fourth Embodiment

Figure 3:
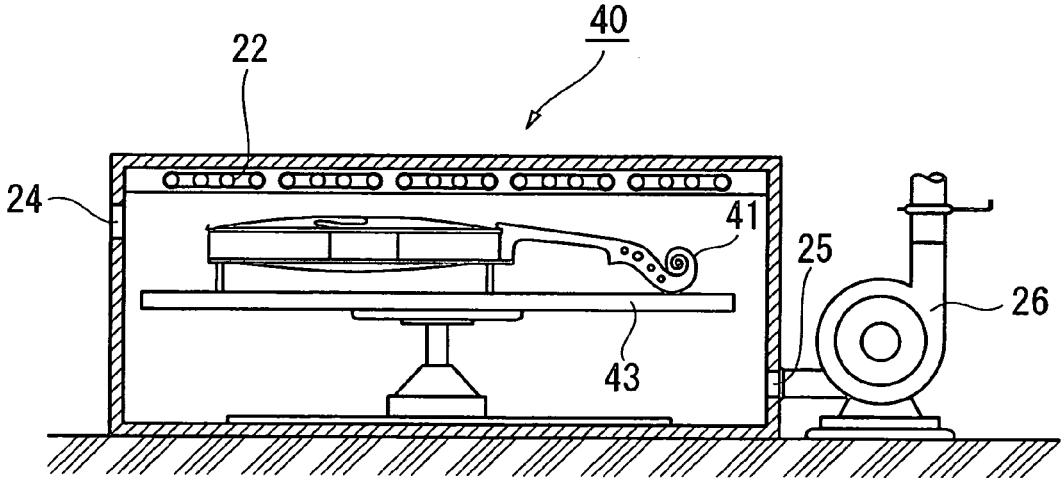
FIG. 3 is an outline cross-section showing example steps of a reforming method of a coating layer of a fourth embodiment of the present invention.

UVC irradiation was conducted on a violin 41 which has characteristics similar to the violins used in the second and third embodiments, in accordance with conditions of Table 2, by using a UVC irradiation apparatus 40 shown in FIG. 3, and sound quality changes of the violin 41 were evaluated.

In this embodiment, inside a UVC irradiation apparatus 40, a rotary table 43 which has an adjustable height instead of the mounting table is provided, the violin 41 is mounted on the rotary table 43 and the violin 41 is rotatable in the UVC irradiation apparatus 40. Both the condition of UVC irradiation and the distance from the low-pressure mercury lamp 22 are the same as the second embodiment, the rotary table 43 is rotated at 12 rpm, and UVC irradiation was conducted on the violin 41. In accordance with such an operation, it is possible to irradiate UVC on the violin 41 evenly and equally.

The UVC irradiation apparatus 40 has its horizontal plane which is larger than the UVC irradiation apparatus 20 in order to make the violin 41 rotatable inside.

The temperature of the irradiated surface just after irradiating with UVC was 64° C. at most on the front face and back face, and 71° C. at most on the side face. That is, the temperature was a little lower than the second embodiment and this was because, it was considered that, irradiation was a little disturbed due to irradiated positions when the violin 21 was fixed as shown in the second embodiment, and the cooling effect by air was larger when the violin 41 was rotated as shown in this embodiment.

The professional player played the violin 41 of this embodiment along with the violins of the second and third embodiments on which UVC was operated, the violin 41 was evaluated to have almost the same sound quality as the violins on which UVC was operated in the second and third embodiments.

A Fifth Embodiment

Figure 4:
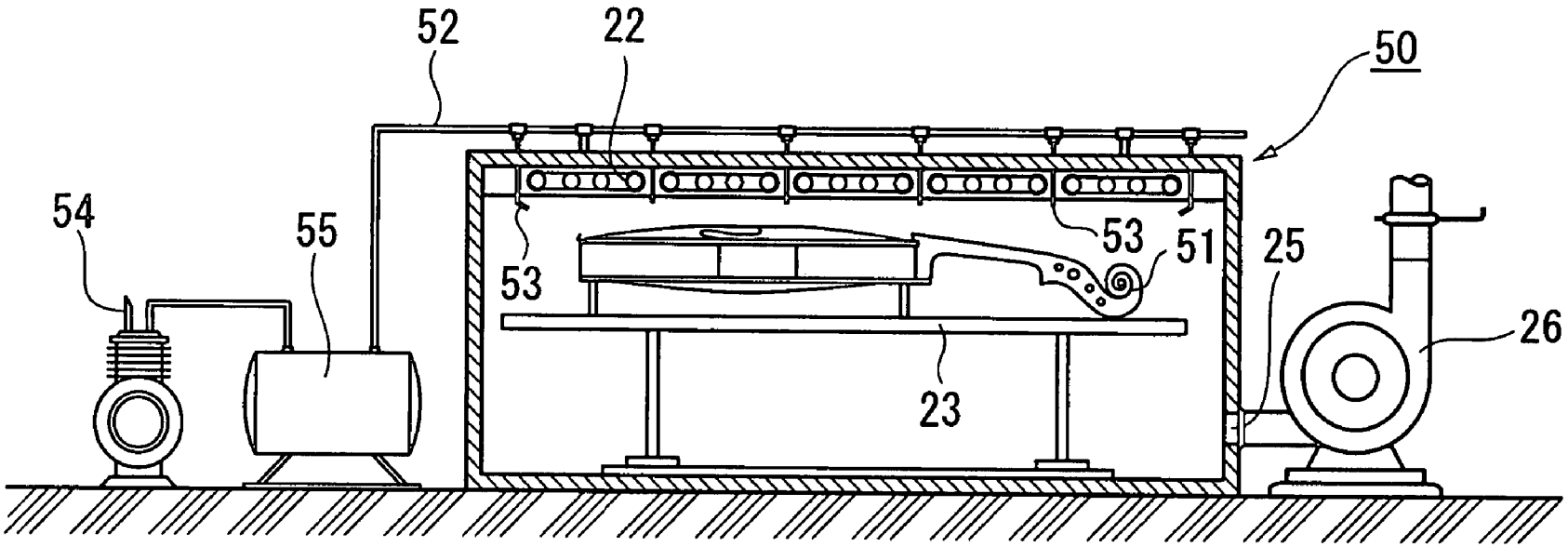
FIG. 4 is an outline cross-section showing example steps of a reforming method of a coating layer of a fifth embodiment of the present invention.

UVC irradiation was conducted on a violin 51 which has characteristics similar to the violins used in the second to fourth embodiments in accordance with conditions of Table 2, by using a UVC irradiation apparatus 50 shown in FIG. 4, and sound quality changes of the violin 51 were evaluated.

The UVC irradiation apparatus 50 has a nozzle 53 in order to blow compressed air at any time and, via a pipe 52, the nozzle 53 was connected to a compressed air tank 55 which was in turn connected to a compressor 54. The ventilation pump 26 was provided via the outlet 25 to the UVC irradiation apparatus 50.

A distance between the violin 51 and the low-pressure mercury lamp 22 was the same as the second embodiment. After irradiating with UVC on the front and back sides of the violin 51 for 10 minutes while blowing compressed air, the violin 51 was taken out of the UVC irradiation apparatus 50, the violin 51 was left as it was for 5 minutes without forcible cooling by compressed air, and such a cycle was repeated 3 times. That is, UVC irradiation time was 30 minutes one side in total. On the other hand, with respect to side faces, after irradiating with UVC for 6 minutes while blowing compressed air, the violin 51 was taken out of the UVC irradiation apparatus 50, the violin 51 was left as it was for 4 minutes without forcible cooling by compressed air, and such a cycle was repeated 3 times. That is, UVC irradiation time was 18 minutes in total.

Just after UVC irradiation, there is almost no temperature difference on both the irradiated surfaces and it was 61° C. at most.

In this embodiment, the violin 51 was taken out of the UVC irradiation apparatus 50 after irradiating with UVC, however, it was possible to omit such a removal operation if it was possible to prevent the increase of temperature on the irradiated surfaces efficiently by adjusting the amount of compressed air blown while irradiating with UVC.

When the professional player played the violin 51 of this embodiment, the evaluation was almost the same sound quality as the second-fourth embodiments.

A Sixth Embodiment

Figure 5:
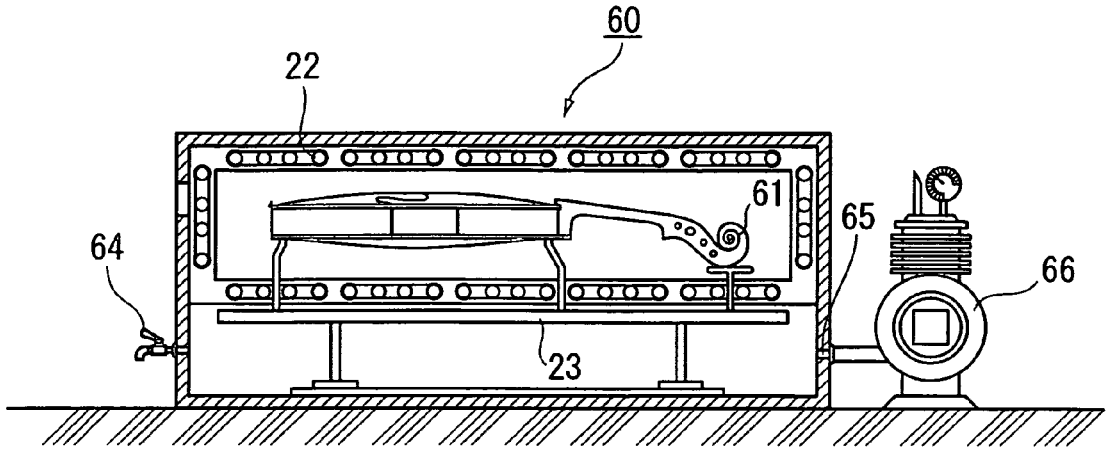
FIG. 5 is an outline cross-section showing example steps of a reforming method of a coating layer of a sixth embodiment of the present invention.

UVC irradiation was conducted on a violin 61 which had characteristics similar to the violins used in the second to fifth embodiments, in accordance with conditions of Table 2, by using a UVC irradiation apparatus 60 shown in FIG. 5, and sound quality changes of the violin 61 were evaluated.

A UVC irradiation apparatus 60 is an apparatus which has higher airtightness, to which a vacuum pump 66 is provided via an outlet 65, and which is designed to reduce its inside air pressure to be that of a vacuum (air pressure is equal to or less than 0.02 Mpa) by operating the vacuum air pump 66. An air pressure retrieval bulb 64 is provided to the UVC irradiation apparatus 60, and it is possible to retrieve from the vacuum state by opening the bulb 64.

The distance between the violin 61 and the low-pressure mercury lamp 22 was the same as the third embodiment. After reducing the air pressure for 5 minutes and irradiating with UVC continuously on the front and back faces of the violin 61 for 2 minutes, the vacuum state was retrieved in two minutes.

After taking the violin 61 out of the UVC irradiation apparatus 60, the violin 61 was cooled for 5 minutes by blowing compressed air from a compressor on the irradiated surfaces, and such a cycle was operated 10 times in total. That is, UVC irradiation time was 20 minutes per surface in total.

Moreover, the same UVC irradiation operation was additionally repeated 10, 20, 30 or 40 cycles, that is, UVC irradiation time was 40, 60, 80 or 100 minutes respectively per surface, and the sound quality of the violin 61 was evaluated in each case and compared to the result of the 20-minute UVC irradiated violin.

When the professional player played the violin 61 of this embodiment, with respect to the case of performing 10 cycles of the UVC irradiation, almost the same effects were confirmed as the second-fifth embodiments. On the other hand, with respect to the case of operating 20 cycles, compared to the case of 10 cycles, there was no improved acoustic effect, however, the sound was restrained and there was a tendency in which it was difficult to sound strongly with thickness. That is, it was confirmed that there is a limitation of acoustic effects by UVC operation. In the case of 30 cycles, there was almost same effect of the case of 20 cycles, however, in the case of 40 cycles, the sound was clearly degraded and tone or timbre became harsh. In the case of 50 cycles, its acoustic characteristics degraded further, and with respect to the violin 61, external changes of the coating such as chaps and cloudiness appeared clearly and it was impossible to maintain as the coating.

In a vacuumed atmosphere of this embodiment, even though the same irradiation apparatus and the same distance for irradiating were used, a tendency was observed such as larger irradiation effects of UVC than in air under a normal pressure. This is because UVC, especially of 184.9 nm, is not reduced by oxygen in the irradiation apparatus. Moreover, it is possible to prevent heat conduction inside the irradiation apparatus, therefore, it is advantageous for controlling the heat of the irradiated surface of the violin 61.

In accordance with the results of this embodiment, it is understood that the limit of UVC irradiation time is 60 minutes (30 cycles of UVC irradiation). The amount of UVC irradiation differs in accordance with irradiation atmospheres (such as in air, in nitrogen atmosphere or the like) even though the irradiation time is the same, therefore, this is a supposition, however, in an operation in air and upon applying the same irradiation distance, 90 minutes that is 1.5 times longer than this embodiment, is a practical irradiation limit.

A Seventh Embodiment

Figure 6:
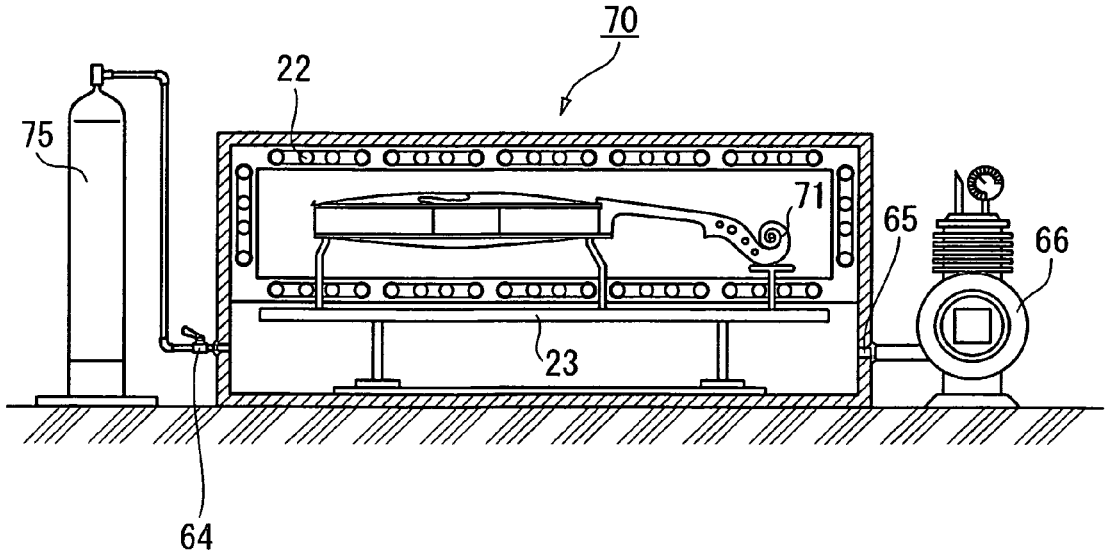
FIG. 6 is an outline cross-section showing example steps of a reforming method of a coating layer of a seventh embodiment of the present invention.

UVC operation was conducted on a violin 71 which had characteristics similar to the violins used in the second to sixth embodiments, in accordance with conditions of Table 2, by using a UVC irradiation apparatus 70 shown in FIG. 6, and sound quality changes of the violin 71 were evaluated.

In this embodiment, via a pipe, a nitrogen bottle is connected to the air pressure retrieval bulb 64 of the UVC irradiation apparatus 60 used in the sixth embodiment, and by applying such an apparatus, UVC irradiation is operated in an atmosphere of nitrogen gas which is an inert gas. That is, in a state in which the air pressure retrieval bulb 64 is closed, inside of the UVC irradiation apparatus 70 is suctioned by using the vacuum pump 66, after that, the air pressure retrieval bulb 64 is opened and the nitrogen is lead inside the UVC irradiation apparatus 70 from the nitrogen bottle 75. A distance between the violin 71 and the low-pressure mercury lamp is set the same as the third and sixth embodiments, and UVC irradiation is operated.

In this embodiment, a UVC irradiation cycle is as shown below. That is, after reducing the air pressure for 5 minutes inside the UVC irradiation apparatus 70 and exchanging nitrogen in 2 minutes, UVC is irradiated continuously on the front and back faces of the violin 71 for 2.5 minutes. After taking the violin 71 out of the UVC irradiation apparatus 70, the violin 71 was cooled for 3 minutes by blowing compressed air from a compressor on the irradiated surfaces, and such a cycle was operated 10 times in total. UVC irradiation time was 25 minutes per a surface in total.

In this embodiment, the area was smaller than in the vacuumed atmosphere of the sixth embodiment, however, a tendency was observed such as larger UVC irradiation effects than in air under normal pressure. Moreover, it is observed that there was a tendency in which the effect of self-cooling was larger and temperature increase was prevented while the irradiation was conducted.

The professional player played the violin 71 of this embodiment and almost the same effects were confirmed as the second-sixth embodiments.

TABLE 2

| | | | Embodiments | | | | | |
|---|---|---|---|---|---|---|---|---|
| | | | 2 | 3 | 4 | 5 | 6 | 7 |
| | Irradiation Methd | | Once/One Surfac | All Surfaces At A Time | Once/One Surfac | Once/One Surfac | All Surfaces At A Time | All Surfaces At A Time |
| | Characteristics | | Basic Style | Basic Style | Rotery Table | Blow Cooling Air While Irradiating | Vacuumed Atmosphere | Netrogen Atmosphere |
| Time Condition | Front/ Back Board | Time of 1 Cycle(min) | 15 | 15 | 15 | 15 | 14 | 12.5 |
| | | Irradiation Time(min) | 5 | 3 | 5 | 10 | 2 | 2.5 |
| | | Cooling Time(min) | 10 | 12 | 10 | 5 | 5 | 3 |
| | | Vacuuming Time(min) | | | | | 5 | 5 |
| | | Retrieving Time(min) | | | | | 2 | |
| | | Time for Exchanging to Netrogen(min) | | | | | | 2 |
| | | Cycle Count(times) | 6 | 10 | 6 | 3 | 10 | 10 |
| | | Front/Back Board Resp. Irradiation Time | 30 | 30 | 30 | 30 | 20 | 25 |
| | | Total Irradiation Time(min) | 60 | 30 | 60 | 60 | 20 | 25 |
| | | Working Time(min) | 180 | 150 | 180 | 90 | 140 | 125 |
| | | Highest Surface Temparature(° C.) | 70 | 68 | 64 | 61 | — | — |
| | Side Face | Time of 1 Cycle(min) | 10 | — | 10 | 10 | — | — |
| | | Irradiation Time(min) | 3 | — | 3 | 6 | — | — |
| | | Cooling Time(min) | 7 | — | 7 | 4 | — | — |
| | | Vacuuming Time(min) | | | | | — | — |
| | | Retrieving Time(min) | | | | | — | |
| | | Time for Exchanging to Netrogen(min) | | | | | | — |
| | | Cycle Count(times) | 6 | — | 6 | 3 | — | — |
| | | Total Irradiation Time(min) | 36 | — | 36 | 36 | — | — |
| | | Working Time(min) | 120 | — | 120 | 60 | — | — |
| | | Highest Surface Temparature(° C.) | 75 | 65 | 71 | 61 | — | — |
| | Total Working Time hour:min | | 5:00 | 2:30 | 5:00 | 2:30 | 2:20 | 2:05 |
| Distance Condition | Front/ Back Board | Closest Portion(mm) | 30 | 30 | 30 | 30 | 30 | 30 |
| | | Farthest Portion(mm) | 50 | 50 | 50 | 50 | 50 | 50 |
| | Side Face | Closest Portion(mm) | 15 | 25 | 15 | 15 | 25 | 25 |
| | | Farthest Portion(mm) | 115 | 125 | 115 | 115 | 125 | 125 |

An Eighth Embodiment

In accordance with the result of the second-seventh embodiments, economical and reasonable methods of UVC irradiation are (i) irradiating with UVC on all surfaces at the same time in air under normal pressure, (ii) forcible cooling by blowing compressed air on the irradiated surface while irradiating with UVC, (iii) setting the distance of the closest approach from the front/back face to the UVC light source to be 30 mm and setting the distance of the closest approach from the side face to the UVC light source to be 15 mm, and (iv) repeating a 15-minute cycle 3 times including both 10-minute UVC irradiation and 5 minutes of forcible cooling outside the UVC irradiation apparatus.

By combining these conditions, conducting UVC irradiation for 30 minutes in 45 minutes total operation time, almost the same effects as the second-seventh embodiment were obtained even though it took the half time of these embodiments. Moreover, in this embodiment, there was little difference in the temperature of the irradiated surfaces 60-65° C., and therefore, it was possible to decrease the rising of temperature.

A Ninth Embodiment

By using violins on which coatings other than an oil varnish are applied, under conditions the same as the seventh embodiment except for the coatings, UVC irradiation was conducted and sound quality changes were evaluated.

A violin was manufactured by applying materials which have similar characteristics to the materials from which the violin of the second embodiment is manufactured. The violins were coated with the alkyd resin coating (coating thickness 20-40 μm), the alcohol varnish (coating thickness 10-35 μm), the cellulose lacquer (coating thickness 50-80 μm), the polyester resin coating (coating thickness 70-90 μm), or the polyurethane resin coating (coating thickness 90-110 μm), two types of violins on which UVC was irradiated and not irradiated were prepared, and the violins were evaluated. It should be noted that, in order to make these violins chemically stable and to make their moisture percentage content stable, the violins had been kept for 3-4 month after coating and after that, UVC was irradiated.

The professional player played the ten violins and, even though there were differences in degree depending on the coatings, same as the seventh embodiment, almost the same effects of improving sound quality was confirmed as in the second-seventh embodiments. Remarkable improvements were observed especially in cases of polyurethane resin coating and cellulose lacquer coating, and a great effect was observed in the case of polyester resin coating.

In this embodiment, the coating thicknesses were different depending on the coatings, therefore, it is not possible to distinguish which caused the effects of improving sound quality. That is, such phenomena mention that the effects of UVC on the coating were not chemical effects, but physical effects such as cutting molecular chains. It is suggested that this is clear because the coating was already cured or, in other words, dried before irradiating with UVC.

A Tenth Embodiment

In order to confirm how long it takes to obtain improving effects of sound quality by irradiating with UVC, sound quality changes of a violin are observed by using a violin with similar characteristics to the second to seventh embodiments and by operating UVC irradiation with same conditions as the third embodiment except for gradually performing UVC irradiation cycles which are divided into smaller steps. It should be noted that the violin used in this embodiment was coated with the oil varnish in the same coating thickness as the third embodiment. On the other hand, in order to compare and contrast, both a violin which is used in the second embodiment and on which UVC is not irradiated and a violin which was used in the third embodiment and on which UVC was not irradiated were evaluated respectively. Steps are as shown below.

After irradiating with UVC continuously for 3 minutes, the violin was taken out of the irradiation apparatus and cooled down by blowing compressed air from the compressor on the irradiated surfaces for 12 minutes, and such operations were included in one cycle. The sound quality of the violin was evaluated every 2, 4, 6, 8 and 10 cycles, that is, 6, 12, 18, 24 and 30 minutes of total UVC irradiation time.

As a result, after operating 2 cycles, almost no sound quality change was observed, and after operating 4 cycles, it was not enough as an effect, however, sound quality changes were observed. After 6 cycles, it was confirmed that the violin had almost the same level of sound quality as the violin of the third embodiment on which UVC was irradiated. After 8 cycles, the sound quality of the violin had improved and it was impossible to determine which was better between the violin of this embodiment and the violin of the third embodiment on which UVC was irradiated. The violin after 10 cycles had the same sound quality as the violin after 8 cycles.

Therefore, it has confirmed that in order to obtain an improvement of sound quality, it takes at least 12 minutes irradiation.

A COMPARATIVE EXAMPLE 1

A violin which has similar characteristics to the second embodiment has selected and sound quality changes of this violin were evaluated after irradiating with UVC in a manner the same as the second embodiment except for setting the violin 50 mm apart from the low-pressure mercury lamp 22 comparing to the second embodiment. In other words, the uppermost portions of the front/back faces were set apart from the lowermost portion of the low-pressure mercury lamp 22 at a position of 80 mm, and the board of the violin as a whole was set apart from the lowermost portion of the low-pressure mercury lamp 22 at a position of 100 mm. Upon irradiating on the side faces, the violin was set at a position of 65-165 mm from the lowermost portion of the low-pressure mercury lamp 22.

Three violins including the UVC-irradiated and not irradiated violins of the second embodiment and the violin of this comparative example were evaluated. It should be noted that with respect to the two violins of the second embodiment, the evaluator was told beforehand that which one was irradiated and which one is not irradiated. However, with respect to the violin of this comparative example, its background was not explained at all, and they were evaluated by applying the other conditions the same as the second embodiment.

As a result, all the evaluators recognized the UVC-irradiated violin of the second embodiment correctly, and, with respect to the violin of this comparative example, approximately ⅔ of the evaluators recognized the violin on which UVC was not irradiated and approximately ⅓ answered uncomprehensive. However, with respect to the violin of this comparative example, the professional player gave an evaluation in which there was a portion of feeling of the violin on which UVC was irradiated.

In accordance with the evaluations above and a characteristic of quick attenuation in distance of 184.9 nm component in UVC, it is recognized that, in order to improve tone or timbre of the violin, it is important to set the front/back faces of the violin at a position of 50 mm or closer to the low-pressure mercury lamp 22 upon irradiating with the UVC in air.

A SECOND COMPARATIVE EXAMPLE

Figure 14:
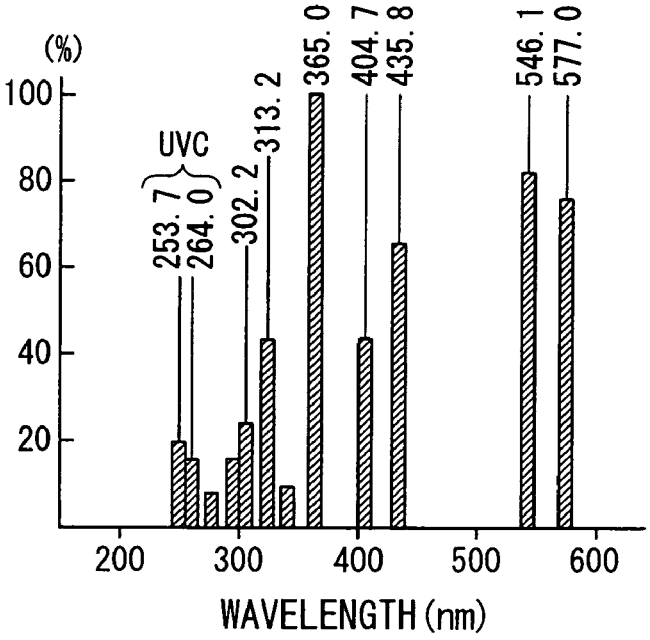
FIG. 14 is a graph showing a spectral distribution of a high-pressure mercury lamp used in a comparison example.

The low-pressure mercury lamp 22 of the UVC irradiation apparatus of the second embodiment was changed to a high-pressure mercury lamp which has the same shape, the irradiation of ultraviolet was performed, and sound quality changes of the violin were evaluated. A spectrum distribution of the high-pressure mercury lamp is shown in FIG. 14. It is clear from the figure that the light irradiated from the high-pressure mercury lamp includes a visible ray, and it is ultraviolet which has UVA (320-400 nm) and UVB (280-320 nm) as principle components and is not UVC. The peak strength is at 365.0 nm and is in UVA region.

With respect to the violin on which the polyurethane resin coating is coated and UVC is not irradiated from the irradiation apparatus in the ninth embodiment, the ultraviolet light of the components above was irradiated except for UVC, and the irradiation operation on the violin was operated by applying other conditions same as the second embodiment.

Moreover, cycles of ultraviolet irradiation was increased from 6 cycles to 12, 30, 60 and 120 cycles, and the violin was evaluated.

As a result, in cases of 6 cycles, which is same as the second embodiment, 12 cycles and 30 cycles, no improvement or sound quality change was recognized. In the case of 60 cycles, a similar tendency as the second embodiment was recognized, however, its degree was not sufficient. In a case of 120 cycles, effects similar to the second embodiment were recognized, however, because of the length of time on the irradiation operation of ultraviolet light, external and significant changes such as chaps, cloudiness and the like appeared.

In other words, it was recognized that, in accordance with the wavelength of the light for irradiation, effects on the coating are greatly different and, by operations with UVA and UVB in this comparative example, there is not an improvement of sound quality on the same level as UVC.

A THIRD COMPARATIVE EXAMPLE

Figure 7A:
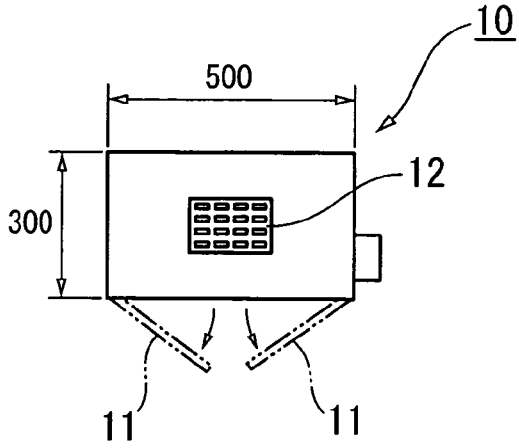
FIG. 7 is an outline figure showing a near ultraviolet irradiation apparatus in a comparison example 3.
Figure 7B:
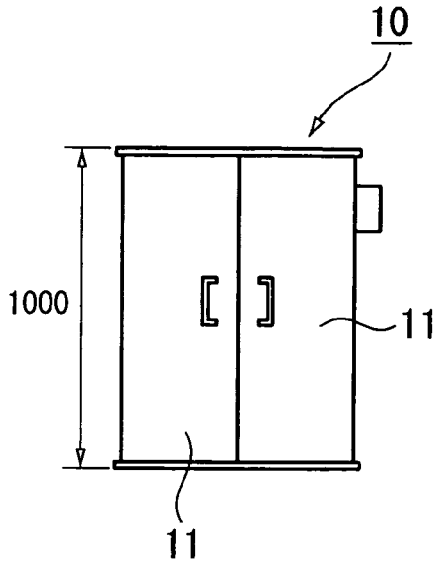

By applying the UVA irradiation apparatus 10 shown in FIGS. 7A and B and irradiating UVA, sound quality changes of the violin were evaluated. FIG. 7A and FIG 7B are respectively an outline plane figure and an outline side view of the UVA irradiation apparatus 10 from the upper side, and the unit of size in the figures is mm. A ventilating opening 12 is provided on an upper face of the UVA irradiation apparatus 10 which is approximately in a rectangular parallel-pipe shape, and one side of the faces is constituted from a door 11.

Figure 7C:
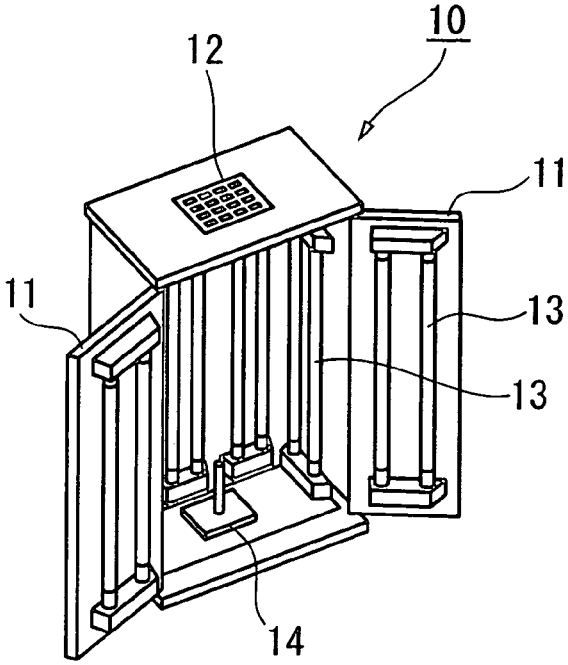
Figure 15:
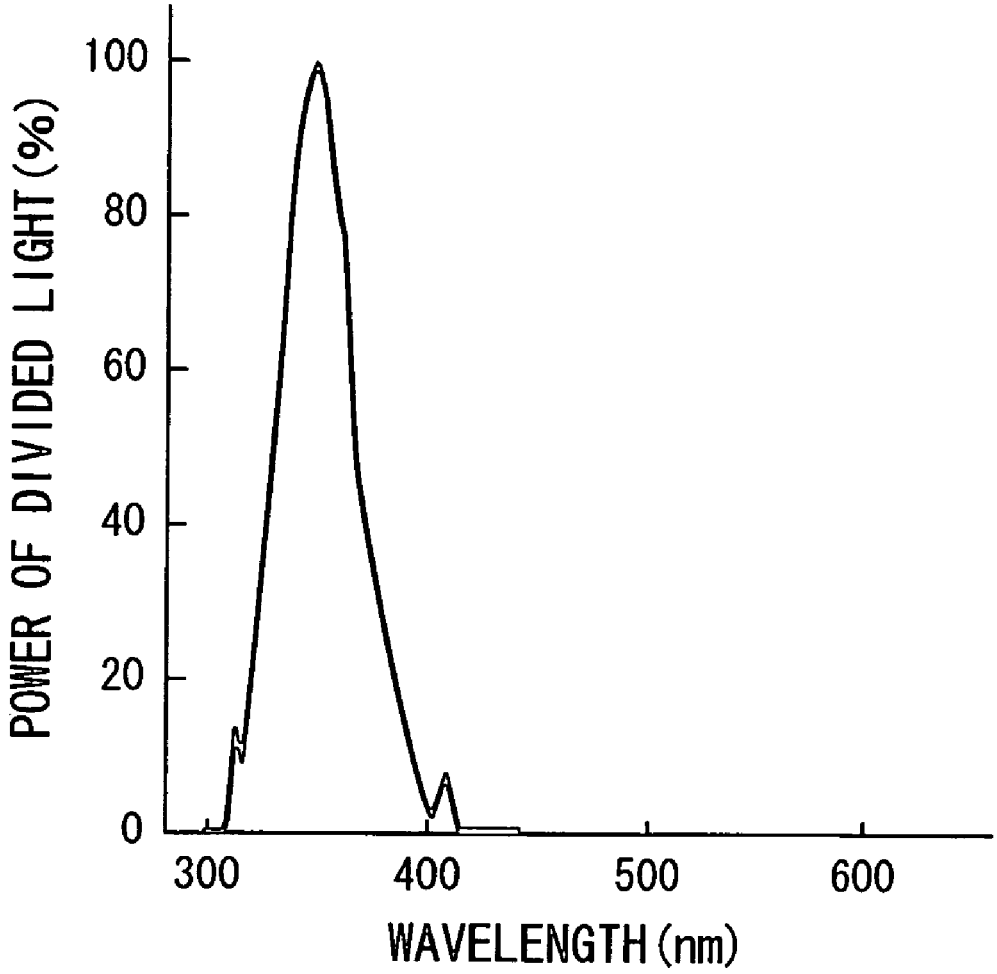
FIG. 15 is a graph showing a spectral distribution of a black lamp used in a comparison example.

FIG. 7C is an outline oblique perspective view of the apparatus 10. On a surface of the door 11 and a surface adjacent to the door 11, two black lights 13 which are light sources of UVA are provided, and on a surface facing the door 11, four black lights 13 are provided. These black lights 13 are in the same shape as a fluorescent lamp of a straight pipe and have a diameter of 32 mm and a length of 580 mm. A spectrum distribution of the black light 13 is shown in FIG. 15. The peak strength is approximately 350 nm.

Inside the apparatus 10, a supporting table 14 is set in order to support and fix the violin, and by putting a bar of the supporting table 14 into an end pin hole, the scroll is set to be an upper face and the violin is set in a manner in which the front face and the back face are facing the walls on which the four black lights are provided.

Figure 7D:
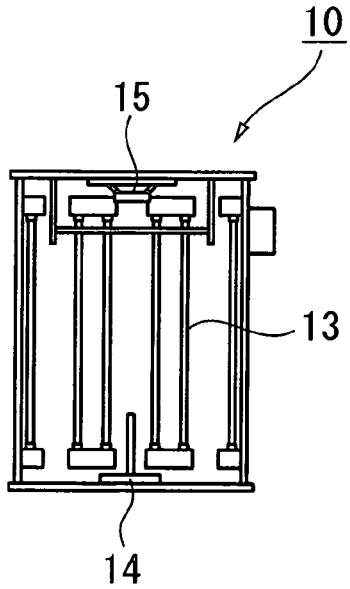

FIG. 7D is an outline cross section of the apparatus 10 in a state in which the door 11 is open. On an upper face inside the apparatus 10, a ventilating fan 15 is provided at a position corresponding to the ventilating opening 12, and, by using the ventilating fan 15, it is possible to prevent over heating inside the apparatus 10 even while UVA irradiation is operated. Comparing to the low-pressure mercury lamp or the like, the black light 13 generates less heat, therefore, it is possible to irradiate continuously for a longer amount time. The violin which is used in the ninth embodiment, on which the cellulose lacquer is coated and on which UVC is not irradiated was set inside the UVA irradiation apparatus 10 so as to set in the distance the same as the fourth embodiment. Sound quality changes were evaluated in the steps shown below after irradiating UVA.

That is, UVA was irradiated continuously for 8 hours and after leaving it still over a night, UVA was irradiated for 8 hours more, therefore, UVA was irradiated for a total of 16 hours. After that, similar operations of leaving over night and irradiating 8 hours were repeated 3 times more, and moreover, 4 times more, therefore, irradiation was operated for a total of 40 hours and 72 hours. Then the violin was evaluated respectively after irradiating.

As a result, after irradiating 8 hours or 16 hours, there were no sound quality change of the violin, and after irradiating 40 hours, a slight indication of change was recognized. However, the change was much smaller than in the ninth embodiment. After irradiating for 72 hours, there was almost no change from the violin after irradiating for 40 hours, therefore, it was observed that effects of irradiating UVA are at a peak by irradiating for 40-50 hours.

On the other hand, the violin after irradiating for 72 hours was left for a month and after that, the violin was evaluated again, however, sound quality changes disappeared. That is, sound quality changes by irradiating UVA improves fluxionality (plasticity) of the coating layer temporally, therefore, this mentions that the effect was different from the physical effects on the coating layer by UVC.

In accordance with results above, by applying the present invention, it is possible to reform the coating layer on the surface of a musical instrument by irradiating far ultraviolet light with a high energy level for a very short time, and it was observed that a musical instrument which has the same excellent sound quality as a musical instrument after deterioration with age is obtained.

Moreover, because reforming steps take such a short time and are simple, and it is possible to obtain cost effective musical instruments.

In accordance with the present invention, it is possible to make a musical instrument including components of the musical instrument on which far ultraviolet is irradiated or a musical instrument on which far ultraviolet is irradiated in short time, and the musical instrument has a same excellent sound quality as a musical instrument after deterioration with age. Just simple production steps are needed for making it. Therefore, it is possible to provide cost effective musical instruments.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A component of a musical instrument which comprises a coating layer on which an aged coating operation is conducted, wherein ultraviolet rays that have a maximum spectrum peak in a far ultraviolet wavelength region (280 nm or less) and have another spectrum peak at 200 nm or less are irradiated on the coating layer.

2. A musical instrument which comprises a coating layer on which an aged coating operation is conducted, wherein ultraviolet rays that have a maximum spectrum peak in a far ultraviolet wavelength region (280 nm or less) and have another spectrum peak at 200 nm or less are irradiated on the coating layer.

3. A production method of a component of a musical instrument which includes a coating layer on which an aged coating operation is conducted comprising steps of:

coating the component; and irradiating ultraviolet rays that have a maximum spectrum peak in a far ultraviolet wavelength region (280 nm or less) and have another spectrum peak at 200 nm or less on the coating layer.

4. A production method of a musical instrument which includes a coating layer on which an aged coating operation is conducted comprising steps of:

coating the musical instrument; and irradiating ultraviolet rays that have a maximum spectrum peak in a far ultraviolet wavelength region (280 nm or less) and have another spectrum peak at 200 nm or less on the coating layer.

5. A production method of a component of a musical instrument according to claim 3, wherein energy of the ultraviolet rays in the far ultraviolet wavelength region is 50% or more compared to total energy of the ultraviolet rays.

6. A production method of a component of a musical instrument according to claim 3, wherein the ultraviolet rays are irradiated in a vacuum.

7. A production method of a component of a musical instrument according to claim 3, wherein the ultraviolet rays are irradiated in an inert gas atmosphere.

8. A production method of a component of a musical instrument according to claim 3, wherein the ultraviolet rays are irradiated by using a low-pressure mercury lamp.

9. A production method of a musical instrument according to claim 4, wherein energy of the ultraviolet rays in the far ultraviolet wavelength region is 50% or more compared to total energy of the ultraviolet rays.

10. A production method of a musical instrument according to claim 4, wherein the ultraviolet rays are irradiated in a vacuum.

11. A production method of a musical instrument according to claim 4, wherein the ultraviolet rays are irradiated in an inert gas atmosphere.

12. A production method of a musical instrument according to claim 4, wherein the ultraviolet rays are irradiated by using a low-pressure mercury lamp.

* * * * *